United States Patent [19]

Noonan

[11] 4,305,544

[45] Dec. 15, 1981

[54] DISPOSABLE CAT LITTER HOLDING MEANS

[76] Inventor: Wallace Noonan, 5 Stanworth La., Allentown, N.J. 08501

[21] Appl. No.: 133,222

[22] Filed: Mar. 24, 1980

[51] Int. Cl.[3] ..... B65D 25/14; B65D 5/22

[52] U.S. Cl. ..... 229/35; 206/45.34; 119/1

[58] Field of Search ..... 229/32, 33, 35

[56] References Cited

U.S. PATENT DOCUMENTS

| | | | |
|---|---|---|---|
| 886,308 | 4/1908 | Reynolds et al. | 229/35 |
| 2,193,925 | 3/1940 | Huye | 229/35 X |
| 2,339,382 | 1/1944 | Davidson | 229/35 |
| 2,784,900 | 3/1957 | Bauer | 229/35 |
| 2,970,741 | 2/1961 | Stone et al. | 229/41 B |
| 3,639,937 | 2/1972 | Sweeney | 206/45.34 |
| 3,684,155 | 8/1972 | Smith | 119/1 X |
| 3,886,901 | 6/1975 | Zeitter | 229/33 X |
| 4,164,314 | 8/1979 | Edgar | 229/33 |
| 4,192,445 | 3/1980 | Card | 229/35 |

FOREIGN PATENT DOCUMENTS

| | | | |
|---|---|---|---|
| 1084243 | 9/1967 | United Kingdom | 229/35 |
| 1315677 | 5/1973 | United Kingdom | 229/35 |

*Primary Examiner*—Davis T. Moorhead
*Attorney, Agent, or Firm*—Frederick A. Zoda; John J. Kane; Albert Sperry

[57] ABSTRACT

A disposable cat litter holding device such as a box or the like including a horizontally extending bottom preferably rectangular and attached along the ends thereof to upwardly extending end walls and attached at the sides thereof to upwardly extending side walls. An upper side member is secured to each side wall and extends inwardly therefrom horizontally over and parallel to the bottom. Similarly, upper end members extend horizontally inwardly from the upper edge of the end walls horizontally extending over the bottom. Flap means are secured to the sides of the side walls and are adapted to interlock with one another preferably by an interlocking tab and slot device. The end flaps are adapted to be interlocked inside of the end walls such that when the end walls are folded upwardly and the upper ends are folded inwardly a downward bias will be exerted on the interlocked end flaps to cause them to be secured in position and retain the overall structure of the disposable cat litter holding device. The upper end members include upper tabs thereon adapted to interlock with slots in the upper side members to form an upper interlocking device for holding the upper end member extending inwardly horizontally over the bottom and to further bias the end flap means into a vertically extending position to cause overall rigidity of the completed device. The interlocking of the upper tabs into the upper slots defined in the upper side members serves to give significantly additional strength to the sidewall structure. Preferably the material of which the holding device is made is a paperboard with the interior sides thereof coated to be waterproof or a waterproof laminate material.

12 Claims, 4 Drawing Figures

DISPOSABLE CAT LITTER HOLDING MEANS

BACKGROUND OF THE INVENTION

1. Field of the Invention

The present invention deals with the field of cat litter boxes or other types of holding devices. It is conventional for the owner of cat house pets to have a location set aside for the cat including a housing with a granular type litter therein. In this manner it is not necessary to let a cat go outside and cats have been found to be easily domesticated to being completely indoors in this fashion. For this reason the business of providing cat litter and cat litter holding devices has grown greatly over recent years.

2. Description of the Prior Art

Many devices have been designed to retain cat litter in a novel fashion such as those shown in U.S. Pat. Nos. 3,886,901; 3,684,155; 3,639,937; 4,164,314. None of these designs shows the unique characteristics of the present invention.

The main designs currently utilized include hard plastic litter boxes wherein the litter is directly poured and perhaps sprayed with a deodorizing powder or liquid. After usage for approximately one week it is necessary to discard the litter and then clean the litter box. This is quite obviously a very messy and unpleasant duty and as such many attempts have been made to create superior systems.

One example of a superior system is the usage of a hard litter box of metal, wood, plastic or any such desirable material in combination with a plastic liner. The litter is placed in the liner which defines a retainer by being placed in the rigid holding device and then only the plastic liner is discarded. Difficulties have arisen with the breaking of such plastic bags and the obvious unpleasant circumstance created thereby. This difficulty is particularly apparent with usage with multiple cats or a single cat over a longer period of time wherein the weight of the litter as it absorbs the liquids becomes significantly greater than originally and this increase in weight has a great tendency to rip the plastic bag when withdrawn from the box. Also the scratching and clawing by cats which is usually associated with usage of the litter box has a tendency to rip the plastic liner over the floor of the litter box resulting in loss of litter or a complete ripping of the plastic liner when removal from the box is attempted. This clawing or just the weight of the cat or the litter tends sometimes to pull the plastic liner off the retaining sidewalls of the litter box. The present invention provides a means for overcoming these prior art difficulties.

SUMMARY OF THE INVENTION

The present invention provides a disposable cat litter holding means formed of paperboard which is preferably waterproof coated or of a waterproof laminate material to be waterproof. The holding means itself includes a bottom means which is preferably rectangular and extends horizontally to define an upper bottom surface for holding cat litter therein. The bottom surface being rectangular has lateral edges which provide a crease in the paperboard end means will also include an upper tab means which is adapted in cooperation with the upper slot means to form an upper interlocking means to retain and hold the upper end means extending horizontally inward. This upper end means will thereby exert a downward bias on the interconnected end flaps therebelow to hold them in a vertical orientation and insure the overall stability of the paperboard holding means. This upper interlocking means will also and equally importantly retain the sidewalls in the vertical position even during heavy litter loads or during rough usage by a cat. In this manner the interlocking means performs a dual purpose of holding both the endwalls and sidewalls in a vertical orientation with only a single interlocking configuration. Also note that with the use of such paperboard it is preferable to have the grain oriented longitudinally with the bottom means if the bottom means is rectangular. It is also preferable to have the inside surface of the paperboard be coated such as to be waterproof in order to prevent wetting of the paperboard itself.

It is an object of the present invention to provide a disposable device for holding cat litter.

It is an object of the present invention to provide a disposable cat litter box being made of paperboard which is waterproof coated.

It is an object of the present invention to provide a disposable cat litter holding means including horizontally extending inwardly upper lips to prevent the loss of litter during usage.

It is an object of the present invention to provide a disposable cat litter holding means which is of minimal expense and as such can be feasibly used in a completely disposable fashion.

It is an object of the present invention to provide a disposable cat litter holding means which is simple and convenient to construct from the paperboard blank.

It is an object of the present invention to provide a disposable cat litter holding means which can be made of paperboard and still retain structural strength even under the weight of extremely wet cat litter.

It is an object of the present invention to provide a disposable cat litter holding means which minimizes the amount of litter necessary to use in each setup due to the extensive cost of cat litter.

It is an object of the present invention to provide a disposable cat litter holding means which is designed to be a 100% replacement for non-disposable cat boxes.

It is an object of the present invention to provide a disposable cat litter holding means which is not specifically designed to merchandise cat litter.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
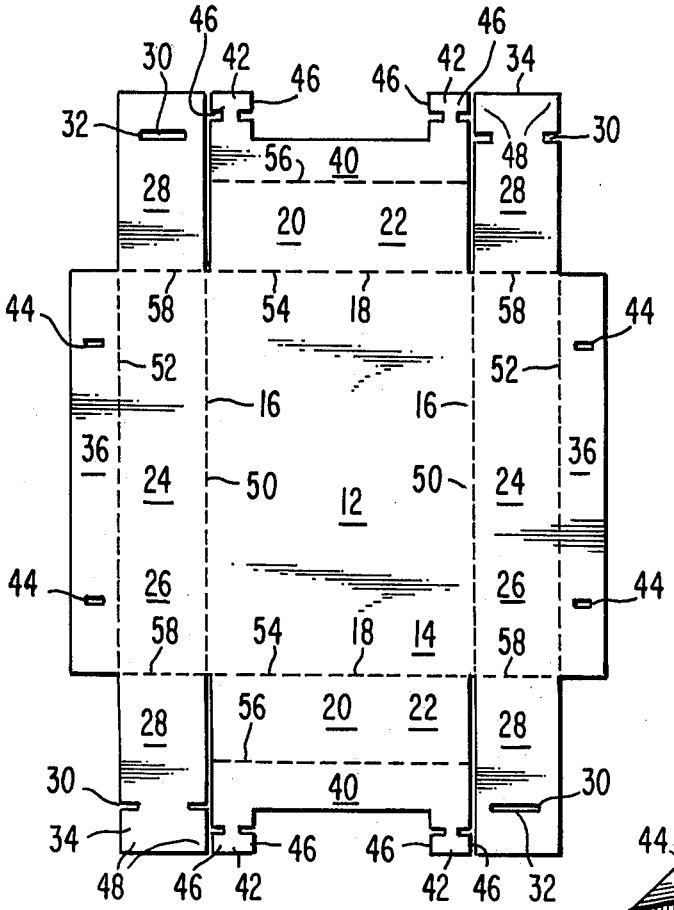
FIG. 1 is a top plan view of an embodiment of a blank for the disposable cat litter holding means of the present invention.
Figure 2:
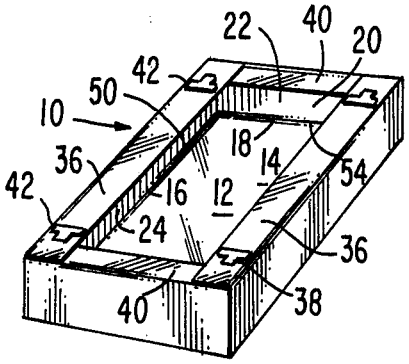
FIG. 2 is a perspective view of the embodiment shown in FIG. 1 folded into the operating condition.
Figure 3:
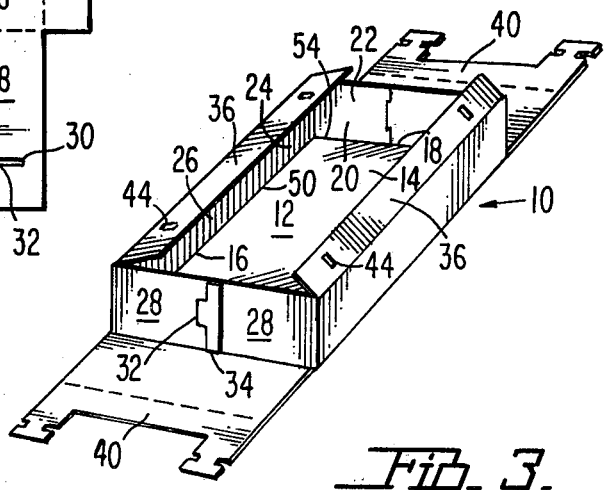
FIG. 3 is a perspective view of the embodiment shown in FIG. 1 in the semi-assembled condition.
Figure 4:
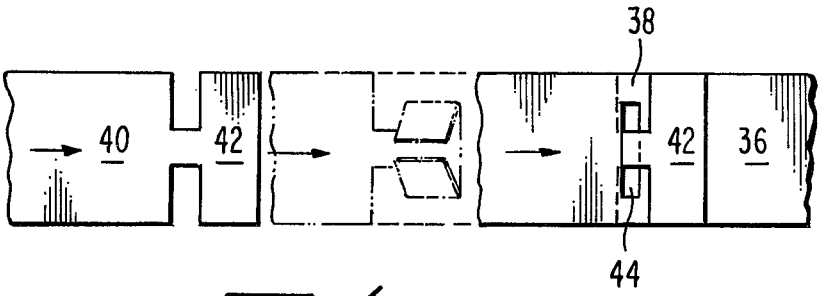
FIG. 4 is an illustration of an embodiment of the upper interlocking means showing in detail the upper tab means and the upper slot means.

The present invention provides a disposable cat litter holding means 10 which is usable for the holding of cat litter therein for use by domestic house pets preferably cats. The holding means 10 includes a bottom means 12 which is preferably rectangular and includes lateral edges 16 along the longer sides and longitudinal edges 18 along the shorter sides. End wall means 20 are secured to and extend upwardly from the longitudinal edges 18 and side wall means 24 are secured to the lateral edges 16 and extend upwardly therefrom. The bottom means 12 includes an upper bottom surface 14. The end wall means 20 includes an inwardly facing end surface 22 and a side wall means 24 include inwardly extending side surfaces 26. In this manner the upper bottom surface 14, the end surfaces 22 and the side surfaces 26 define a chamber for retaining cat litter therein.

Preferably, the holding means 10 is made of a paperboard material including a coated interior surface to thereby make it waterproof. In this manner there will be no soaking of the paperboard material and no leakage of fluids thereout. It is also preferable when forming the holding means 10 of paperboard material to have the paperboard grain run longitudinally with respect to the bottom surface 12 whenever it is rectangular in order to facilitate folding along the longer lateral edges 16 and specifically along creases 50 and 52.

Each side wall means 24 will include an end flap means 28 extending outwardly from each lateral side thereof. The end flap means will be adapted to extend inwardly perpendicular to the side surface such as to be placed adjacent or in an interlocking fashion with the end flap means of the opposing side wall adjacent thereto. The end flap means 28 will preferably also include an end interlocking means 30 such as end slot means 32 and end tab means 34 to facilitate holding of the side wall means 24 vertically by interlocking of the end flap means 28.

Each side wall means 24 will include an upper side means 36 extending from the upper edge thereof inwardly horizontally over the bottom means 12 but disposed upwardly therefrom. Each upper side means will also preferably define two upper slot means 44 therein.

Each end wall means 20 will also include in a similar fashion an upper end means 40 extending from the uppermost edge thereof horizontally inwardly over the bottom means 12. In this manner the upper end means 40 and the upper side means 36 will provide a rim around the upper surface of the holding means 10 which will provide increased stability to the overall design in consideration of it being made of paperboard and will also provide a protection against the loss of litter during usage. To facilitate interlocking of the upper side means 36 and the upper end means 40 into position an upper tab means 42 will be preferably integrally connected to the upper end means 40 and be adapted to extend into the upper slot means 44 defined by the upper side means 36. In this manner the end wall means 20 will be secured in the upper position and the upper end means 40 will be secured in the horizontally extending inward position. Also, the upper end means will thereby exert a downward bias against the interlocked end flap means 28. This downward bias will hold the end flap means 28 secure with respect to one another and will exert stability on the overall total configuration. Furthermore, the securement between upper tab means 42 and upper slot means 44 will cause the upper side means 36 to be drawn inwardly on both sides of the litter box 10. In this manner the sidewall means 24 will be held into a vertically or nearly vertically extending orientation even if the box 10 is filled with litter and even if it is in use. The upper tab means 42 and the upper slot means 44 together will define the upper interlocking means 38.

Preferably the end tab means 34 will include end tab ears 48 and the upper tab means 42 will include upper tab ears 46. With both configurations the ears will be adapted to be folded inwardly to allow the tab to extend through the respective slot and once this operation has been achieved the ears can be folded outwardly to interlock the tab with respect to the slots. This interlocking action is shown both for the upper interlocking means 38 and for the end interlocking means 30.

In operation the blank of the disposable cat litter holding means 10 will be provided in a flat orientation. It will then be necessary for the user to fold the sidewall means 24 upwardly with respect to the bottom means 12 by folding along crease 50. Then it will be necessary to fold along crease 58 such that the end flap means 28 will be extending inwardly perpendicular to the sidewall means 24 and with respect to the bottom means 12. With this folding the end slot means 32 and the end tab means 34 will be positioned adjacent one another such that the end interlocking means 30 can be actuated to thereby hold the end flap means 28 in engagement with respect to one another and maintain the sidewall means 24 in an approximately vertical position.

Thereafter the end wall means 20 will be folded upwardly to be perpendicular with respect to the bottom means 12 by folding along creases 54. The upper end means 40 will then be folded inwardly to extend horizontally over the bottom means 12 by folding along creases 56. At this point it will be necessary to fold the upper side means 36 inwardly to extend horizontally over the bottom means 12 by folding along creases 52. This will bring the upper tab means 42 and the upper slot means 44 adjacent to one another to allow interlocking of the upper interlocking means 38. In this manner the upper end means 40 will exert a downward bias on the interlocked end flap means 28 to provide overall rigidity for all four walls of the disposable cat litter holding means 10 as well as for the inwardly extending rim formed by the combination of the upper side means 36 and the upper end means 40. The device will now be in an orientation to receive cat litter and can easily be disposed of after usage or after a desired period of time.

While particular embodiments of this invention have been shown in the drawings and described above, it will apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A disposable cat litter holding means comprising:

(a) a one-piece bottom means extending horizontally to define an upper bottom surface thereof for the holding of cat litter thereabove, said bottom means defining lateral edges at opposing lateral sides thereof and longitudinal edges at opposite longitudinal sides thereof;

(b) an end wall means secured with respect to said longitudinal edges of said bottom means and adapted to extend upwardly therefrom to define end surfaces facing inwardly therefrom;

(c) a side wall means secured with respect to said lateral edges of said bottom means and adapted to extend upwardly therefrom to define side surfaces facing inwardly therefrom;

(d) end flap means extending from each lateral end of each side wall means and adapted to extend inwardly perpendicular to said side wall means, parallel to said end wall means, each end flap means further including an end interlocking means adapted to selectively secure together end flap means of adjacent side wall means;

(e) an upper side means secured to the uppermost edge of each side wall means and adapted to extend inwardly perpendicular therefrom horizontally parallel with respect to said bottom means and disposed upwardly therefrom, said upper side means defining an upper slot means therein;

(f) an upper end means secured to the uppermost edge of said end wall means and adapted to extend horizontally perpendicularly inward therefrom parallel with respect to said bottom means and disposed upwardly therefrom, said upper end means further including upper tab means which in cooperation with said upper slot means forms an upper interlocking means to retain said upper end means extending horizontally inward from said end wall means and to retain said sidewall means vertically and to retain said end wall means and said end flap means vertically perpendicular to said bottom means.

2. The means as defined in claim 1 wherein said end interlocking means includes an end slot means and an end tab means adapted to interlock with respect to one another to selectively secure together said end flap means of adjacent side wall means.

3. The means as defined in claim 1 wherein said bottom means is rectangular.

4. The means as defined in claim 1 wherein said holding means is made of paperboard.

5. The means as defined in claim 4 wherein said bottom means is rectangular and the grain of the paperboard is oriented longitudinally therealong.

6. The means as defined in claim 1 including a waterproof coating on at least a portion of the paperboard.

7. The means as defined in claim 1 wherein said holding means is made of plastic.

8. The means as defined in claim 1 wherein said bottom means, said side wall means and said upper side means are integrally formed with respect to one another.

9. The means as defined in claim 1 wherein said bottom means, said end wall means and said upper end means are integrally formed with respect to one another.

10. The means as defined in claim 1 wherein said bottom means and said end flaps are integrally formed with respect to one another.

11. The means as defined in claim 1 wherein said upper end means extends horizontally inwardly from said end wall means to downwardly bias said end flap means into a fixed vertically extending position.

12. A disposable waterproof-coated paperboard cat litter holding means comprising:

(a) a one-piece bottom means being rectangular and extending horizontally to define an upper bottom surface thereof for the holding of cat litter thereabove, said bottom means defining lateral edges at opposing lateral sides thereof and longitudinal edges at opposing longitudinal sides thereof, the grain of the paperboard being oriented longitudinally with respect to said rectangular bottom means;

(b) an end wall means secured with respect to said longitudinal edges of said bottom means and integral therewith, said end wall means being adapted to extend upwardly therefrom to define end surfaces facing inwardly therefrom;

(c) a side wall means secured with respect to said lateral edges of said bottom means and integral therewith, said side wall means being adapted to extend upwardly therefrom to define side surfaces facing inwardly therefrom;

(d) end flap means extending from such lateral end of each side wall means and being integral therewith, said end flap means being adapted to extend inwardly perpendicular to said side wall means parallel to said end wall means, each end flap means further including an end interlocking means adapted to selectively secure together end flap means of adjacent side wall means, said end interlocking means including an end slot means and an end tab means adapted to interlock with respect to one another to selectively secure together said end flap means of adjacent side wall means;

(e) an upper side means secured to the uppermost edge of each side wall means and integral therewith, said upper side means being adapted to extend inwardly perpendicular therefrom horizontally parallel with respect to said bottom means and disposed upwardly therefrom, said upper side means defining an upper slot means therein, (f) an upper end means secured to the uppermost edge of said end wall means and being integral therewith, said upper end means being adapted to extend horizontally perpendicularly inward therefrom parallel with respect to said bottom means and disposed upwardly therefrom, said upper end means further including upper tab means which in coooperation with said upper slot means forms an upper interlocking means to retain said upper end means extending horizontally inward from said end wall means and to retain said side wall means vertically and to retain said end wall means and said end flap means vertically perpendicular to said bottom means, said upper end means extending horizontally inwardly from said end wall means to downwardly bias said end flap means into a fixed vertically extending orientation.

* * * * *